US006109202A

United States Patent [19]

Topman et al.

[11] Patent Number: 6,109,202

[45] Date of Patent: Aug. 29, 2000

[54] COMBINATION WHISTLE

[75] Inventors: Simon Manville Topman, Sutton Coldfield; Michael Colin Sharp, Solihull, both of United Kingdom

[73] Assignee: J. Hudson & Co. (Whistles) Ltd., United Kingdom

[21] Appl. No.: 09/229,015

[22] Filed: Jan. 12, 1999

[30] Foreign Application Priority Data

Jan. 14, 1998 [GB] United Kingdom ..... 9800609

[51] Int. Cl.[7] ..... G10K 5/00; B06B 3/00

[52] U.S. Cl. ..... 116/137 R; 116/140; 446/204; 446/216

[58] Field of Search ..... 116/137 R, 140; 84/383 R, 398, 402, 410, 453; 446/216, 202, 203, 204

[56] References Cited

U.S. PATENT DOCUMENTS

| | | | |
|---|---|---|---|
| 632,184 | 8/1899 | Johnson . | |
| 4,709,651 | 12/1987 | Lance | 116/137 R |
| 4,821,670 | 4/1989 | Foxcroft et al. | 116/137 R |
| 5,086,726 | 2/1992 | Sharp . | |
| 5,113,784 | 5/1992 | Forselius | 116/137 R |
| 5,495,820 | 3/1996 | Seron | 116/140 |
| 5,507,246 | 4/1996 | Rand, Jr. | 116/137 R |
| 5,816,186 | 10/1998 | Shepherd | 116/137 R |

FOREIGN PATENT DOCUMENTS

| | | |
|---|---|---|
| 553 | 11/1909 | United Kingdom . |
| 20 | 1/1916 | United Kingdom . |

*Primary Examiner*—Diego Gutierrez
*Assistant Examiner*—Faye Francis
*Attorney, Agent, or Firm*—Welsh & Katz, Ltd.

[57] ABSTRACT

A comprising a body (1) provided at each end with a mouthpiece (3',6) having an air passage which communicates with a sound chamber (4,5), the chambers each being provided with a vent ($V_1$, $V_2$) in which is located an air splitter arranged so that air blown into the chamber through the associated mouthpiece is directed to the air splitter. The two vents ($V_1$, $V_2$) open at opposite sides of the body (1) so that the whistle can be blown from either end with the associated air vent exhausting in an upward direction by rotating the whistle about a generally horizontal axis when changing ends. One of the sound chambers (5) contains a pea and is provided with a protuberance (3*c*) arranged to project into the associated vent ($V_2$) to prevent the pea becoming stuck in the vent. This chamber is of conical shape at one end.

13 Claims, 8 Drawing Sheets

COMBINATION WHISTLE

BACKGROUND OF INVENTION

This invention relates to whistles and more particularly, but not exclusively, to a dog whistle of the combination type.

Combination dog whistles have been made for more that 80 years, Nevertheless, it is believed that all operating parameters have not been optimized in a single design and there still tends to be a number of problems associated with such whistles that, as yet, have not been overcome. Combination dog whistles usually have a first mouthpiece at one end with an associated sound chamber having an air vent, and a second mouthpiece at the other end also with an associated sound chamber having an air vent. A pea or cork ball is usually provided in one of the sound chambers.

One problem which arises with conventional combination whistles is that the movement required to change ends to enable the whistle to be blown alternately at both ends is somewhat clumsy and takes a longer time than is desirable when issuing commands to a dog.

Another problem that may occur is the pea (or cork ball) "sticking" in the vent of its sound chamber during blowing. This problem has been around for many years and tends to be a nuisance but has not yet been obviated.

A further problem which is extremely important resides in the fact that when the combination whistle is blown gently it produces a lower frequency than when it is blown very hard; as pressure increases through the blowing range so does the frequency. A large frequency range produced when blowing such whistles gently or hard can cause confusion on the part of the dog trained to respond to the sound of the whistle. Of course, it is of paramount importance that clear command signals can be conveyed to the dog in a reliable manner which can be easily repeated. The conveyance of such reliable signals may make all the difference, for example, between a champion dog winning a trial and the dog simply not hearing and realizing what task he is required to carry out according to the sound of the whistle.

Thus, it is believed to be important that the frequency variation possible when blowing the whistle gently or hard is restricted more than is the case with present whistles of this type which, as previously explained, can cause confusion on the part of the dog.

Equally, it is important that the correct signal can be conveyed to the dog over different working distances and it is believed that parameters have not been optimized in such whistles to convey clear signal information to the dog more particularly over a long distance. Usually one sound chamber of a combination type whistle (not containing a pea) is used to give a quite clear and specific command in a relatively narrow frequency range that will be used for close work (short distances). However, with some dogs (long ear channel dogs) it has been discovered that a wider frequency variation is needed over a longer distance to be more effective. Thus, the features selected to be included in the particular dog whistle combination need to be correlated with the particular type of dog that the whistle is to be used for.

SUMMARY OF THE INVENTION

It is an object of the present invention to provide a whistle which at least alleviates one or more of the aforementioned problems or to provide a whistle which is improved in at least some respect.

According to the present invention there is provided a combination whistle in which the two air vents open at opposite ends of the body of the whistle so that the whistle can be blown from either end with the associated air vent exhausting in an upward direction by rotating the whistle about a substantially horizontal axis and without the need when changing ends to turn the whistle about a vertical axis.

At least one of the sound chambers may contain a pea, cork ball or other like element, and in this event the said chamber is preferably provided with a protuberance arranged to project into the associated vent thereby to prevent the element from becoming stuck or lodged in the associated vent when air is blown into the chamber through the associated mouthpiece.

Usually, the protuberance will be provided at the inner end of an airflow directing means or ramp provided in an air passage connecting the relevant mouthpiece to the associated chamber.

Preferably, the protuberance includes an inclined surface positioned adjacent to the vent, said surface extending at 45°±5° relative to a transverse plane perpendicular to the axis of the sound chamber. If this angle were smaller the protuberance would restrict the exhausting of air through from the vent and cause stalling of the element.

Preferably, the protuberance provides a flat end wall preferably of 0.3175±0.0175 cm which preferably extends generally at right angles to the axis of the sound chamber and which is preferably positioned below, and adjoining the bottom of, the inclined surface. Altering the dimensions of the wall varies the frequency of the sound chamber.

Preferably, the end wall is positioned on a central axis of the sound chamber and adjoins respective upright wall portions on either side of the end wall which are angled outwardly towards the associated mouthpiece of the sound chamber.

The sound chamber may be defined in part by a peripheral edge extending at 15°±5°. This angle is important because greater or smaller angles affect the movement of the element and the trill effect produced by the element and the consistency of the frequencies generated.

Each airflow directing means or ramp is preferably provided with air turbulence means which may be in the form of one or more blind holes in order to restrict the frequency variation.

The sound chamber is preferably adapted in order to produce a trill sound frequency on average of about 3400±50 hertz in a range preferably about 2700 to 3500 hertz.

At least one of the mouthpieces may be provided with means such as a rib extending around the mouthpiece to enable it to be gripped and held by the teeth.

Many advantageous features of the present invention will be evident from the following description and drawings.

BRIEF DESCRIPTION OF THE DRAWINGS

An embodiment of a combination dog whistle will now be described, by way of example only, with reference to the accompanying drawings in which.

DETAILED DESCRIPTION

Figure 1:
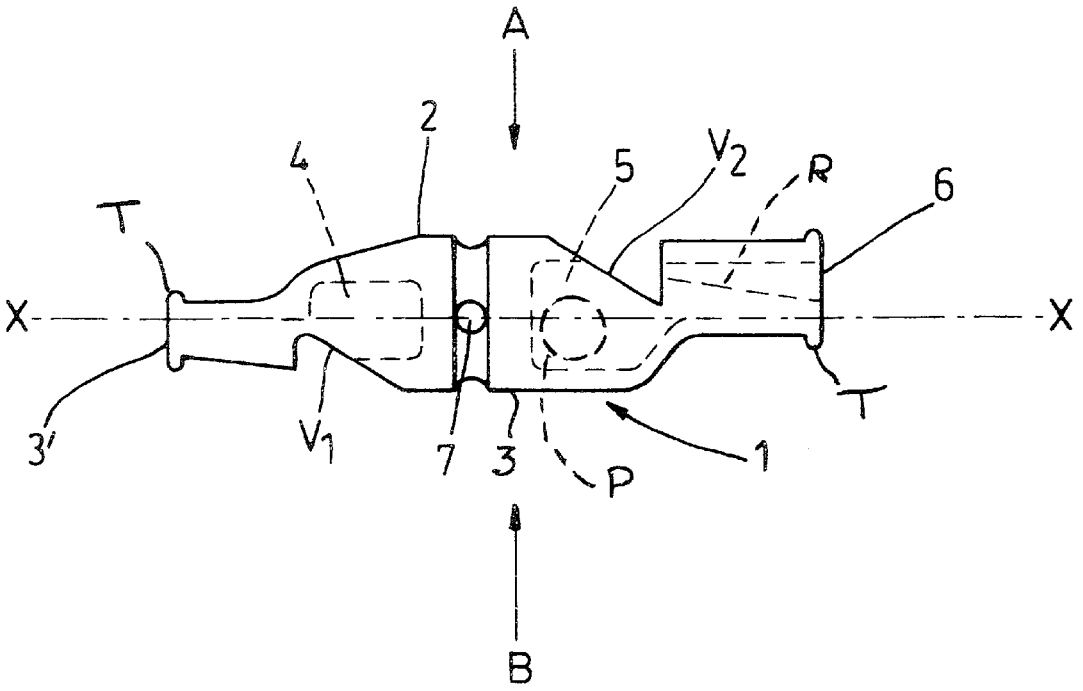
FIG. 1 shows a side view of the whistle.

Referring to the drawings, a combination dog whistle comprises a body 1 formed in two parts, namely an upper part 2 (see FIGS. 2,3,4 and 5) joined to a lower part 3 (see FIGS. 7,8,9 and 10). Eight integral pegs p provided on the upper part (see FIGS. 2 and 6*b*) are engageable during assembly of the whistle in associated holes h formed in the lower part (see FIGS. 7 and 11*b*).

FIG. 1 shows a side view of the assembled whistle with a notional split line between the upper and lower parts being denoted X—X.

As shown in FIG. 1, the left end of the whistle has a mouthpiece 3' leading to a first sound chamber 4 having a vent $V_1$, and the right end of the whistle has a mouthpiece 6 communicating with a sound chamber 5 provided with a vent $V_2$. The vents $V_1$ and $V_2$ open at opposite sides of the body of the whistle.

A central transverse hole 7 is formed in a solid part of the body 1 of the whistle so that it is not in communication with either of the sound chambers 4, and 5, this hole being used for a lanyard or cord so that the whistle can be carried on the user's neck or wrist in well known manner.

In FIG. 1 the whistle is shown in the position in which it is placed when the right hand mouthpiece 6 is required to be used, i.e. with the associated vent $V_2$ positioned to vent air upwardly. To bring the left hand mouthpiece into a position for use, i.e. with its associated vent $V_1$ arranged to exhaust upwardly, the only movement that is needed is turning of the whistle about a generally horizontal axis corresponding generally to the axis of the hole 7. There is no need to turn the whistle about a vertical axis which would make it less easily maneuverable.

In order to understand the internal structure of the whistle 1 the upper and lower parts 2 and 3 are shown in some detail in FIGS. 2 to 6*b* and FIGS. 7 to 12*b* respectively.

Figure 7:
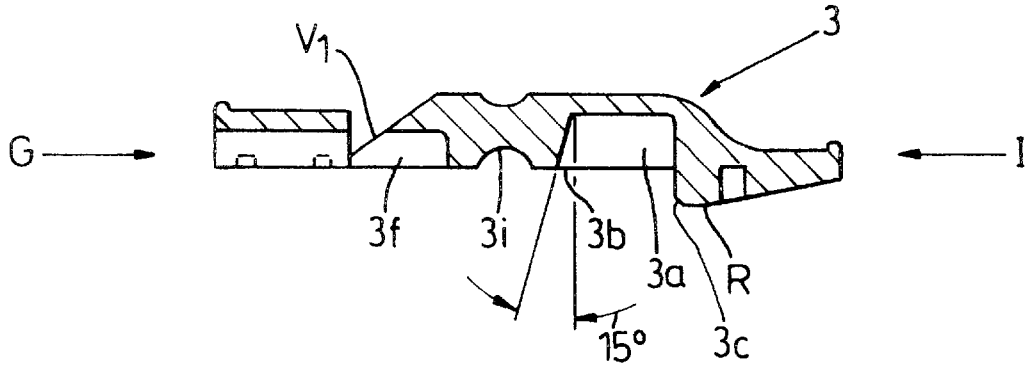
FIG. 7 is a central longitudinal section through a lower part of the whistle shown in an inverted position.
Figure 7A:
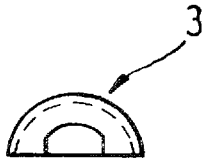
FIGS. 7A and 7B are end views corresponding to FIG. 7 looking in the direction of arrows 'G' and 'I' respectively.
Figure 7B:
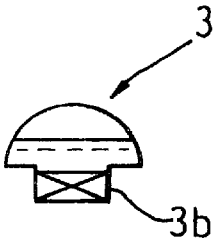
Figure 8:
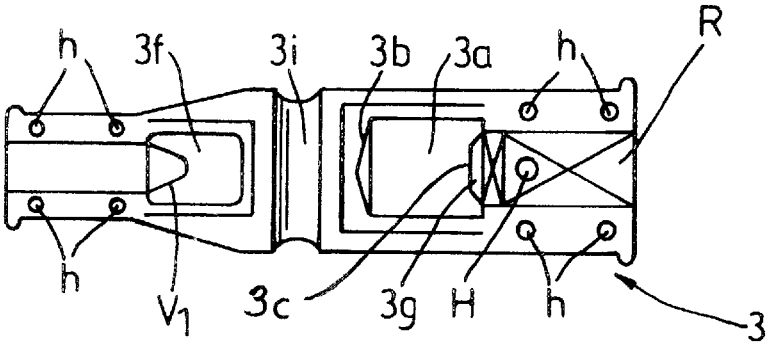
FIG. 8 is a top plan view of the lower part of the whistle.
Figure 9:
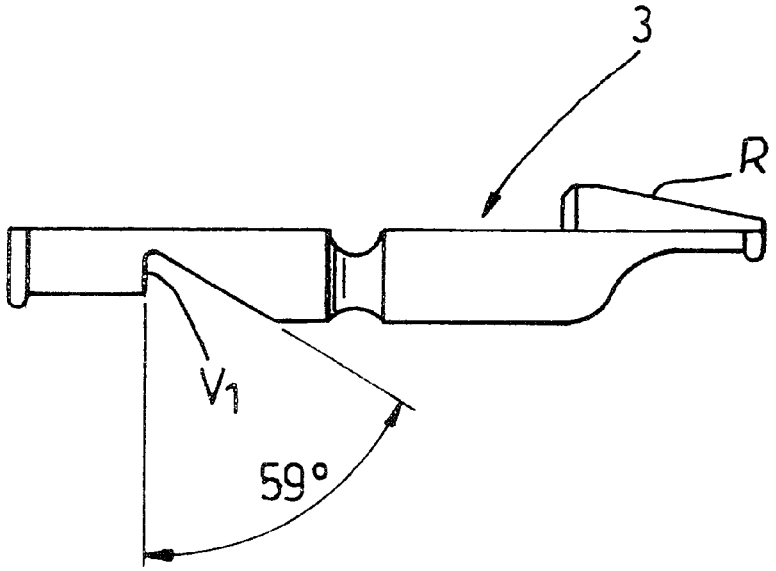
FIG. 9 is a side elevational view of the lower part of the whistle.

The sound chamber 5 provided at the right hand end of the whistle as shown in FIG. 1 is defined by a recess 2*a* formed in the upper part 2 (FIGS. 2 and 3) in cooperation with a recess 3*a* formed in the lower part 3 of the whistle (FIGS. 7 and 8). It is to be noted that the chamber recess 2*a*,3*a* come together to define a generally cylindrical chamber 5 having a conical end defined by part-conical surfaces 2*b* and 3*b*, respectively.

Figure 2:
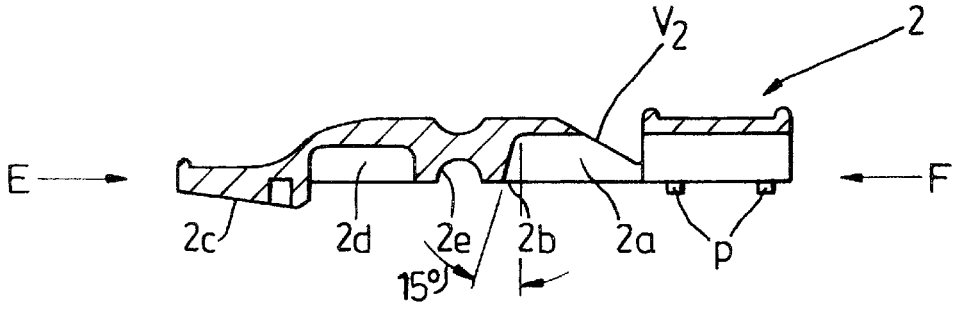
FIG. 2 shows a central longitudinal section taken through an upper part of the whistle.
Figure 2A:
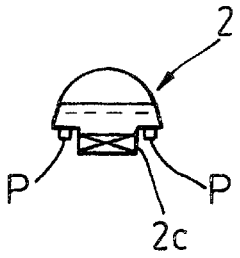
FIGS. 2A and 2B are end views corresponding to FIG. 2 looking in the direction of arrows 'E' and 'F' respectively.
Figure 2B:
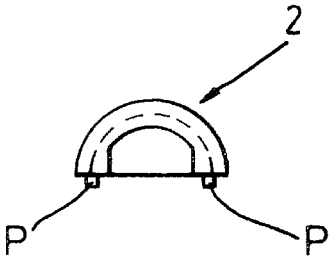

FIGS. 2 and 7 depict the longitudinal angle of the cone with respect to a transverse plane perpendicular to the axis of the chamber 5 as being 15° resulting in a conical end to the chamber which is of shallow conical shape having an internal angle at the apex of 150°.

The sound chamber 4 is also cylindrical and is formed in a similar way, being defined by a part 2*d* formed in the upper part 2 of the whistle body and a part 3*f* formed in the lower part 3, except that it has a flat end face 4*a*.

A pea or cork ball, indicated at "P" in FIG. 1, is located in sound chamber 5 but no pea is provided in chamber 4.

Figure 6:
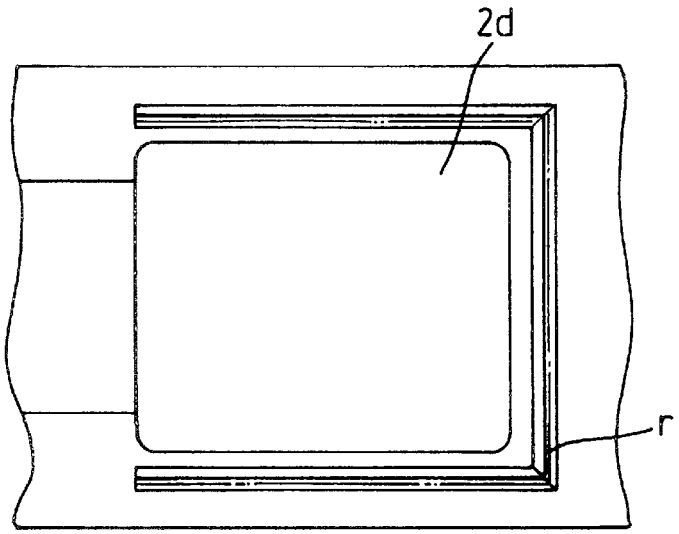
FIG. 6 shows an enlarged detail view of part of FIG. 3.
Figure 6A:
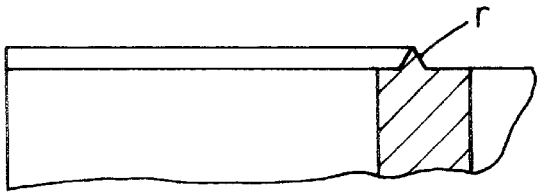
FIG. 6*a* shows a sectional side view detail corresponding to FIG. 6.

As shown in detail in FIG. 6, the part 2*d* of the sound chamber 4 in the upper part of the whistle body is bounded on three sides by a raised rib r which during assembly is seated in a receiving groove g on three sides of the part 3*f* of the sound chamber formed in the lower part 3 of the body (FIGS. 6 and 6*a*). A similar rib and groove arrangement is provided around the sound chamber 5.

Figure 5:
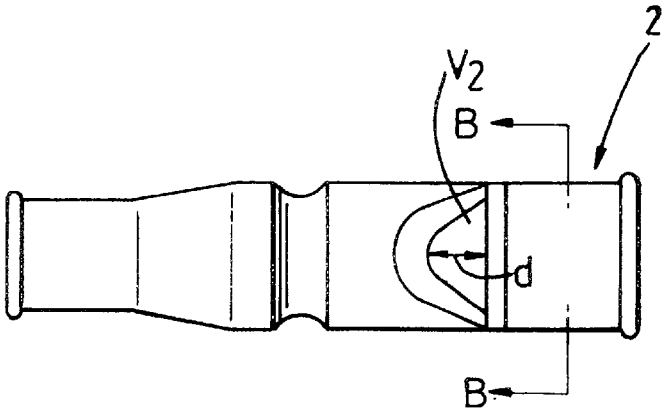
FIG. 5 is a plan view of the upper part of the whistle shown in FIG. 4 looking in the direction of arrow "A" in FIG. 1.
Figure 5A:
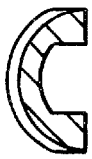
FIG. 5*a* is a transverse cross sectional view taken along line BB of FIG. 5.
Figure 6B:
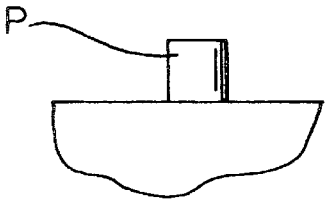
FIG. 6*b* shows a further detail of the upper part of the whistle.
Figure 10:
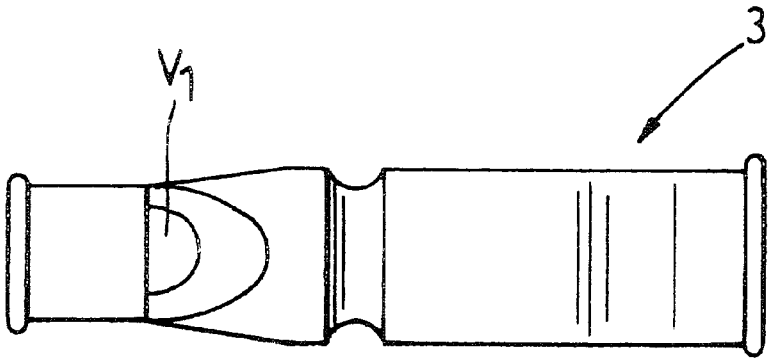
FIG. 10 is an underneath plan view of the lower part of the whistle looking in the direction of arrow "B" in FIG. 1.
Figure 11:
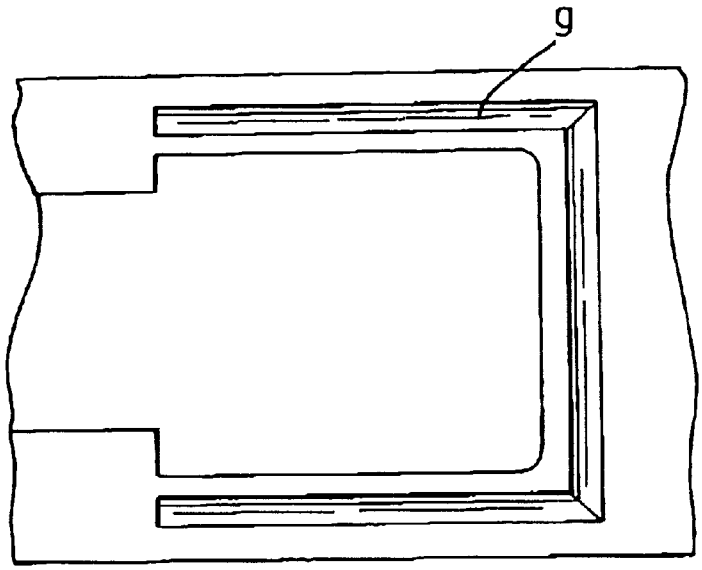
FIG. 11 shows an enlarged fragmentary detail of FIG. 8.
Figure 11A:
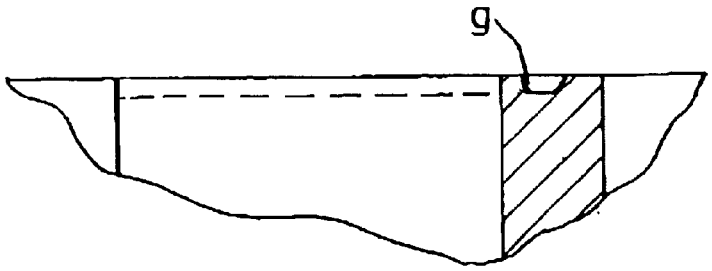
FIG. 11*a* shows a sectional side view detail corresponding to FIG. 11.
Figure 11B:
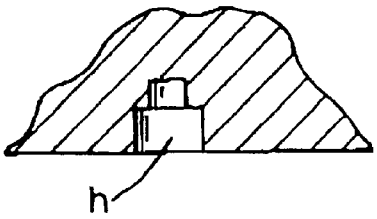
FIG. 11*b* shows a further detail of the lower part of the whistle.

The vents $V_1$, $V_2$ are each provided with a tapering generally curved edge forming an air splitter edge as indicated at S1 and S2 in FIGS. 10 and 5, respectively.

The air splitter edge of vent $V_1$ is at 59° to a transverse plane of the whistle and the air splitter edge of vent $V_2$ is at 51° to a transverse plane of the whistle. These angles are critical for regulating the exhausting of air from the vents which is extremely important for frequency control.

The whistle body is preferably made of polycarbonate material. The two parts 2 and 3 of the body are joined together during manufacture by ultrasonic welding, the pegs p engaged in the holes h and the ribs r engaged in the grooves g providing melt points to ensure an airtight joint.

The chambers 4 and 5 communicate with their respective mouthpieces 3' and 6 through passages defined in the body of the whistle by longitudinal channels formed, respectively, in the upper and lower parts of the body, the mouths of the channels being defined in part by air flow directing ramps R and 2*c* formed in the lower and upper parts respectively. Each ramp acts to direct the airflow produced by blowing the whistle at the relevant end into the associated sound chamber and towards the associated air splitter which thereby produces a whistling sound.

The rectangular inclined surfaces of the airflow directing ramps 2*c* and R are marked with crossing diagonal lines for ease of illustration.

The air flow directing ramp R (see FIGS. 7,8,12 and 12*a*,*b* of the lower part 3 of the whistle 1) is provided with a specially shaped protuberance 3*c* at the end of the ramp remote from the associated mouthpiece 6. It is to be noted that the right hand end of the recess 3*a* of the sound chamber 5 is defined by a pair of peripheral edge surfaces 3*d* (as shown in FIG. 12*a*) each of which forms an included angle of 15° to a transverse plane perpendicular to the longitudinal axis of the sound chamber 5 so as to match the angle of the conical end surface 3*b* of the sound chamber. The surfaces 3*d* have parallel, upright marginal edges 3*e* and 3*f* that define the lateral marginal edges of the protuberance 3*c* (see FIG. 12*b*) and establish a thin flat end wall W of width 0.125" (0.3175 cm) opposite the conical end 3*b* of the chamber 5.

The effect of the shape of the protuberance 3*c* is to provide a downwardly inclined polygonal (near trapezoidal) shaped surface 3*g* positioned in the vent $V_2$. The angle of the surface 3*g* relative to a transverse plane is 45° plus or minus 5° as will be evident from FIG. 12 of the drawings. Thus, the protuberance 3*c* can be thought of as a three-dimensional compounded angle configuration and has been specifically designed to restrict or prevent the pea or cork ball P in the sound chamber 5 from becoming stuck or lodged in the vent $V_2$, this being a common problem with pea type whistles. The diameter of the pea/cork ball will be very slightly greater than the axial dimension d of vent $V_2$ (see FIG. 5).

The 45° angle of the protuberance 3*c* is important in order to allow sufficient air to exhaust through the vent.

Furthermore, the conical end shape 2*b*, 3*b* of the sound chamber 5 more particularly in combination with the protuberance 3*c* acts to create a distinctive trill when air is blown into the mouthpiece 6. The conical shape 2*b*,3*b* of the sound chamber 5 induces the pea or cork ball to "bounce around" or reverberate irregularly continuously during blowing to create a distinctive trill as the pea or cork ball rolls around the surface defining the sound chamber 5. The creation of the unique trilling sound is important as it will enable the listener (i.e. a dog) to recognize the particular whistle. Once a particular dog has been trained, he should always recognize this unique sound.

It is to be emphasized that the design of dog whistle as described has been the subject of many months of research into optimizing parameters thereof so there should be much more effective control of the whistle. Thus, the dimensions and relative dimensions of various parts of the whistle are very important and in some cases critical (to within certain tolerances) to achieve the consistency and control over the sound quality required.

Regarding the conical shape 2*b*,3*b* of the end of sound chamber 5 and the protuberance 3*c*, it is believed that said conical shape contributes about 75% of the improved trill frequency obtainable with the protuberance contributing about 25% of the effect.

The whistle as shown should produce from the whistle element sound chamber 5 an average frequency of 3400±50 hertz where the maximum frequency is 3500 hertz and the minimum frequency is 2700 hertz. There are considerable fluctuations in frequency during the act of blowing the whistle. The frequency variations taper off as the breath is exhausted. This variation in frequency provides the distinctive trill of the whistle that is thought to be achieved by way of the conical end shape 2*b*,3*b* of the chamber and protuberance 3*c*.

The average frequency produced via the mouthpiece 3' and vent $V_1$ (i.e. from the pealess end of the whistle) is 5400 hertz.

Figure 12:
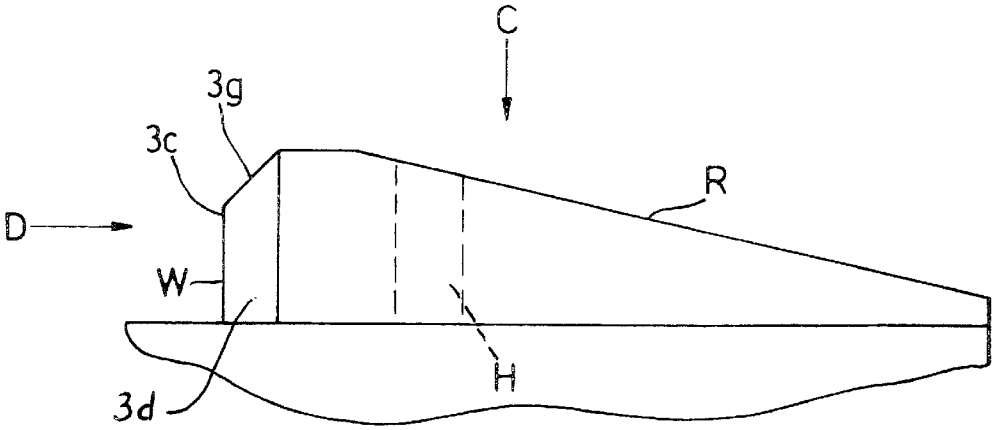
FIG. 12 shows an enlarged detail view of part of FIG. 9.
Figure 12A:
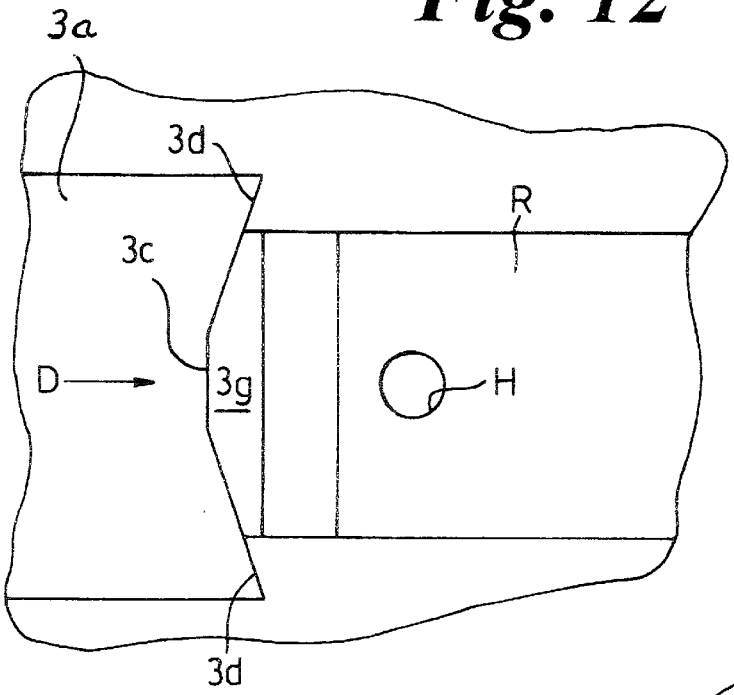
FIG. 12*a* shows an enlarged top view looking in the direction of arrow "C" in FIG. 12.
Figure 12B:
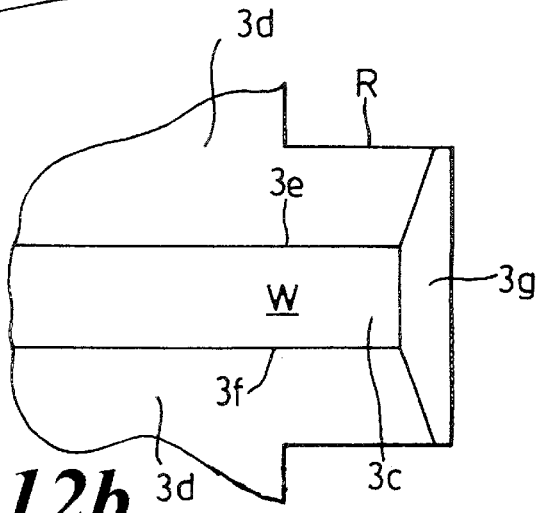
FIG. 12*b* shows an enlarged detail end view looking in the direction of arrow "D" in both FIGS. 12 and 12*a*.

The sound produced by blowing into the mouthpiece is further modified by air turbulator means in the form of one or more blind holes H in the airflow directing ramps 3*c* and R such that shown in the ramp R (see FIGS. 12 and 12*a*).

The function of each air turbulator means is to create turbulence within the air flow in the relevant mouthpiece 3' or 6 to more accurately control the frequency variation of the whistle 2. Usually, it will be important in the whistle to produce a fairly narrow frequency band thus minimizing the possibilities of confusion on the part of the dog who will be trained to respond to a number of different frequency commands. When known whistles of this type are blown gently a lower frequency is produced than when the whistle is blown very hard and as the pressure increases through the blowing range, so does the frequency. The air tubulators should have a stifling effect on this frequency growth so that even when the whistle is blown very hard the frequency variation will be dramatically restricted even if not removed completely.

The holes H also serve to reduce the mass of the plastics material of the whistle body, thereby avoiding sink marks which can occur during the moulding process.

The combination whistle provides a mouthpiece 6 at the right hand end which is to be blown in the orientation shown in FIG. 1 with the vent $V_2$ of the associated sound chamber 5 which contains a pea indicated at P in FIG. 1, opening upwardly. In addition to this, the left hand end of the whistle 1 is provided with mouthpiece 3' having a pea-less sound chamber 4, and this mouthpiece is to be blown with the whistle in an inverted orientation to that shown in FIG. 1 so that vent $V_1$ will also point upwardly when mouthpiece 3' is used. In previous proposals, the sound chamber air vents and air splitters have always been located generally on the same side of the whistle. This has meant that in order to use each of the whistle elements of the combination, the whistle as a whole has to be turned about a generally vertical axis.

With the whistle shown in the drawings this is not the case and whichever mouthpiece 3' or 6 is used, the associated vent is directed generally upwardly and away from the person blowing into the mouthpiece. Advantageously, the reason for this design development is that in research conducted in the Anechoic sound chamber at Birmingham University, it has been discovered that when a whistle is blown with an air vent directed downwardly towards the ground, the ground and the body of the person blowing into the whistle may absorb approximately 20% of the sound volume of the whistle meaning that the whistle may be much more inefficient than would otherwise be the case with the vent of the sound chamber opening upwardly and away from the person blowing the whistle.

In practice, designing the combination whistle with vents which can easily be brought to a position in which they exhaust upwardly, has meant a dramatic effect on the distance the whistle can be effectively heard and on the audibility of the sound at any distance when either mouthpiece 3' or 6 is used.

Figure 3:
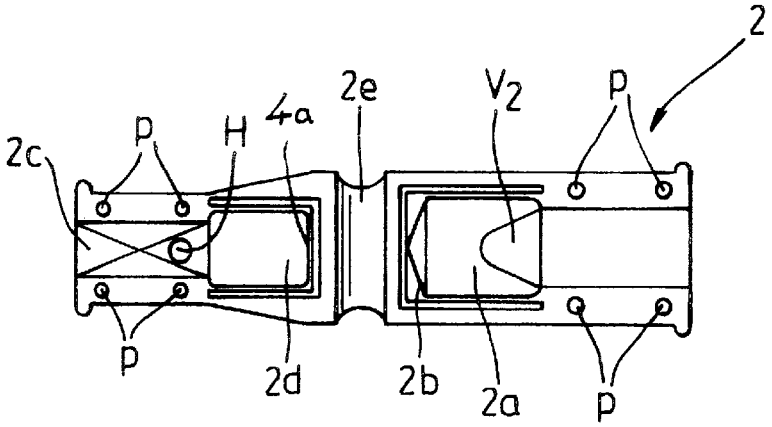
FIG. 3 is an underneath plan view of the upper part of the whistle shown in FIG. 2.
Figure 4:
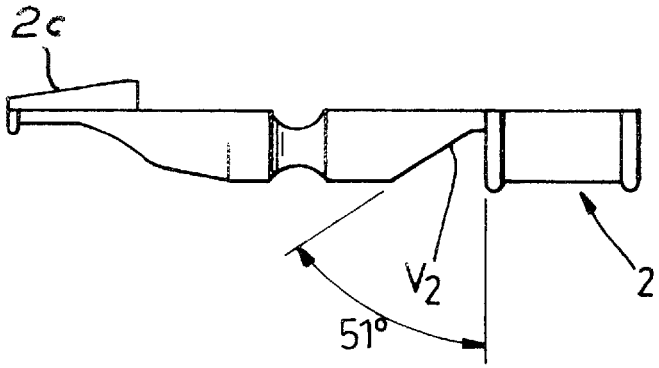
FIG. 4 is a side elevational view of said upper part of the whistle shown in an inverted position.

As shown in FIGS. 2 and 3, the upper part of the whistle 1 is provided with a semi-cylindrical groove 2*e* which mates with a similar semi-cylindrical groove 3*i* of the lower part 3 of the whistle in order to form the hole 7 for a lanyard (not shown) of the whistle.

An additional important feature is the provision of a rib T around each of the mouthpieces 3' and 6 as shown in FIG. 1. This rib enables the mouthpiece to be gripped firmly between the teeth. On other combination dog whistles of this type it tends to be a major fault that because no such ribs are provided, particularly on the "pealess" end of the combination whistle, the whistle can be blown out of the mouth during very hard blowing.

It is to be understood that the scope of the present invention is not to be unduly limited by the particular choice of terminology used herein. Moreover the invention includes any novel and inventive feature disclosed herein either alone or in combination with any one or more other such features.

What is claimed is:

1. A combination whistle comprising a body defining a first mouthpiece at one end of the body which communicates with a first sound chamber having an air vent, said body defining a second mouthpiece at an opposite end of the body which communicates with a second sound chamber having an air vent, characterized in that said air vents open at opposite sides of the body of the whistle so that the whistle can be blown from either end with the associated air vent exhausting in an upward direction by rotating the whistle about a generally horizontal axis when changing ends.

2. A whistle as claimed in claim 1 in which at least one of the sound chamber contains a spherical element, said one of said chambers being provided with a protuberance arranged to project into the associated air vent so as to prevent the spherical element become stuck in the vent.

3. A whistle as claimed in claim 2 including an airflow directing ramp provided in an air passage connecting said one of said sound chambers to the associated mouthpiece, said ramp being arranged to direct air blown into the associated mouthpiece towards airflow responsive means located in the associated vent for producing a whistling sound.

4. A whistle as claimed in claim 3 in which the protuberance includes an inclined surface positioned adjacent said associated air vent.

5. A whistle as claimed in claim 4 in which said inclined surface is inclined at an angle of 45°±5° relative to a transverse plane perpendicular to the longitudinal axis of the sound chamber.

6. A whistle as defined in claim 3 wherein said protuberance is formed at an end of said airflow directing ramp remote from an air entrance in said associated mouthpiece.

7. A whistle as defined in claim 3 wherein said airflow responsive means comprises an air splitter located in the associated vent.

8. A whistle as claimed in claim 2 in which the sound chamber containing said spherical element is defined in part by a non-flat end face at the end thereof remote from said protuberance.

9. A whistle as defined in claim 8 wherein said non-flat end face comprises a conical shaped surface.

10. A whistle as claimed in claim 9 in which the conical end face has an internal angle of 150°±5°.

11. A whistle as defined in claim 2 wherein said spherical element is selected from a group including a pea and a cork ball.

12. A whistle as claimed in claim 1 in which the mouthpieces each have an airflow directing ramp for directing air blown into the mouthpieces towards the associated sound chambers, at least one of the airflow directing ramps being provided with at least one blind hole for creating air turbulence to restrict the frequency variation of the associated sound chamber.

13. A whistle as claimed in claim 1 in which at least one of the mouthpieces is provided with a rib extending around the mouthpiece to enable it to be gripped and held by the teeth.

* * * * *